US008201432B2

(12) United States Patent
Bytow

(10) Patent No.: US 8,201,432 B2
(45) Date of Patent: Jun. 19, 2012

(54) PLATE WORKPIECE PROCESSING WITH INTERCHANGEABLE TOOLS

(75) Inventor: Peter Bytow, Simmozheim (DE)

(73) Assignee: TRUMPF Werkzeugmaschinen GmbH + Co. KG, Ditzignen (DE)

( * ) Notice: Subject to any disclaimer, the term of this patent is extended or adjusted under 35 U.S.C. 154(b) by 574 days.

(21) Appl. No.: 12/390,601

(22) Filed: Feb. 23, 2009

(65) Prior Publication Data

US 2009/0211328 A1 Aug. 27, 2009

(30) Foreign Application Priority Data

Feb. 22, 2008 (EP) ..... 08003217

(51) Int. Cl.
*B21D 28/00* (2006.01)

(52) U.S. Cl. ..... 72/333; 72/446

(58) Field of Classification Search ..... 72/325, 72/326, 327, 332, 333, 441, 442, 446, 447, 72/448; 483/28, 29, 4, 8; 83/698.91, 684, 83/685, 686, 687, 688, 689, 690, 691
See application file for complete search history.

(56) References Cited

U.S. PATENT DOCUMENTS

| | | | | |
|---|---|---|---|---|
| 5,136,521 | A * | 8/1992 | van Daalen et al. | 700/160 |
| 5,438,521 | A | 8/1995 | Lindstrom | |
| 7,168,277 | B2 | 1/2007 | Thomae et al. | |
| 2006/0042341 | A1 | 3/2006 | Nishibu | |

FOREIGN PATENT DOCUMENTS

| | | |
|---|---|---|
| EP | 0 339 832 | 11/1989 |
| EP | 0 417 836 | 3/1991 |
| EP | 1 625 901 | 8/2004 |
| JP | 2006 205199 | 8/2006 |

OTHER PUBLICATIONS

European Search Report from corresponding European Application No. 08003217.0, mailed Jul. 3, 2008, 6 pages.

* cited by examiner

*Primary Examiner* — Mark Rosenbaum
(74) *Attorney, Agent, or Firm* — Fish & Richardson P.C.

(57) ABSTRACT

A plate workpiece processing machine includes a workpiece support, a tool punch holder, a tool die holder, a tool drive, multiple tool punches, and multiple tool dies. Various tool punches and tool dies have tool heads of differing heights. The tool punch holder is positionable based on the tool head height of a tool punch secured to the tool punch holder and/or the tool die holder is positionable based on the tool head height of a tool die secured to the tool die holder.

20 Claims, 3 Drawing Sheets

PLATE WORKPIECE PROCESSING WITH INTERCHANGEABLE TOOLS

CLAIM OF PRIORITY

This application claims priority under 35 USC §119(a) to European Patent Application No. 08 003 217.0, filed on Feb. 22, 2008, the entire contents of which are hereby incorporated by reference.

TECHNICAL FIELD

This invention relates to processing plate-like workpieces, such as cutting and/or forming metal sheets, using a machine with interchangeable processing tools.

BACKGROUND

One example of a machine for processing workpieces is the TruPunch® 5000 punching machine offered by Trumpf Werkzeugmaschinen GmbH+Co. KG. The TruPunch® 5000 punching machine has mono-tool holders, i.e., tool holders to which a single tool, including a tool punch and a tool die, is secured. Further tools are situated in a tool magazine and can be inserted as alternative tools into the mono-tool holders for workpiece processing when required.

The mono-tool holders have a tool punch holder that can be raised and lowered by a hydraulic stroke drive, and a stationary tool die holder. A workpiece table serves to support a metal sheet that is to be processed.

Workpiece processing is effected by lowering the tool punch holder together with a tool punch secured thereto onto the metal sheet supported on the workpiece table. As a result, the tool punch presses on one side of the metal sheet and the tool die presses on the other side of the metal sheet.

The tool punches and the tool dies of the TruPunch® 5000 punching machine have a mushroom-shaped configuration. The tool punches and the tool dies each have a tool shank that is used to secure the tool punches and tool dies to their respective tool holders. The processing devices of the tools in the form of cutting edges or forming bars are provided on tool heads which are radially enlarged relative to the tool shanks.

In designing tools for machines of the type described above, considerable restrictions have to be taken into consideration due to the spatial conditions at the tool holders.

EP 0 417 836 B1 discloses a punching machine in which both a punch holder and a die holder are positionable relative to a workpiece table along a stroke axis in order to compensate for changes in the overall tool heights along the stroke axis due to re-grinding of the punching tools which may be necessary from time to time. Despite those positioning movements for compensating for the slight reduction in the tool heights due to wear, the punching tools for the punching machine known from EP 0 417 836 B1—just as in the case of the TruPunch® 5000 punching machine—are subject to considerable restrictions due to the spatial conditions at the tool holders.

SUMMARY

In one aspect of the invention, a machine for processing (e.g., for cutting and/or forming) workpieces (e.g., plate-like workpieces, such as metal sheets) includes a workpiece support, a tool punch holder to which a tool punch may be secured, a tool die holder to which a tool die may be secured, a tool drive by which the tool punch holder and the tool die holder may be moved towards each other along a stroke axis for processing of a workpiece supported on the workpiece support, and multiple tool punches and tool dies which may be selectively secured to the tool holders for workpiece processing. The tool punches and the tool dies each have a tool shank, which can be used to secure the relevant tool punch to the tool punch holder and to secure the relevant tool die to the tool die holder. There is provided on the tool punches and on the tool dies a respective tool head which adjoins the tool shank along the stroke axis on the workpiece side and which is enlarged radially with respect to the stroke axis and relative to the tool shank. Various tool punches, which have tool heads of differing heights along the stroke axis, and various tool dies, which likewise have tool heads of differing heights along the stroke axis, are provided for workpiece processing. The tool punch holder is positionable based on the tool head height of a tool punch secured to the tool punch holder, and the tool die holder is positionable based on the tool head height of a tool die secured to the tool die holder. The tool punch holder and the tool die holder are positionable relative to the workpiece support along the stroke axis by the tool drive.

In another aspect, a plate workpiece processing machine includes a workpiece support, a tool punch holder configured to hold a tool punch, a tool die holder configured to hold a tool die, a tool drive operable to move at least one of the tool punch holder and the tool die holder to reduce a separation between the tool punch holder and the tool die holder along a stroke axis for processing of a plate-like workpiece supported on the workpiece support, multiple tool punches selectively mountable on the tool punch holder, and multiple tool dies selectively mountable on the tool die holder. Each of the tool punches has a tool punch shank and a tool punch head adjoining the tool punch shank. The tool punch shank of each tool punch is configured to be secured to the tool punch holder and the tool punch head of each tool punch is radially enlarged relative to the tool punch shank and is arranged towards the workpiece when the tool punch is mounted on the tool punch holder. Each of the tool dies has a tool die shank and a tool die head adjoining the tool die shank. The tool die shank of each tool die is configured to be secured to the tool die holder and the tool die head of each tool die is radially enlarged relative to the tool die shank and is arranged towards the workpiece when the tool die is mounted on the tool die holder. The tool punch heads of at least some of the tool punches have differing heights along the stroke axis as mounted on the tool punch holder, and the tool die heads of at least some of the tool dies have differing heights along the stroke axis as mounted on the tool die holder. The tool drive is configured to position the tool punch holder with respect to the stroke axis based on the tool punch head height of a tool punch secured to the tool punch holder, and to position the tool die holder with respect to the stroke axis based on the tool die head height of a tool die secured to the tool die holder.

In some embodiments, the tool punch holder is positionable along the stroke axis in the relevant positions for workpiece processing based on the tool head height of a tool punch secured to the tool punch holder. This can help to ensure trouble-free processing of workpieces despite the use of tools having tool heads of different heights.

In certain embodiments, the tool die holder is positionable along the stroke axis in the relevant positions for workpiece processing.

In some embodiments, the tool die holder is positionable by the tool drive along the stroke axis in a tool-changing position in order for tool dies to be inserted and removed. In certain embodiments, starting from the tool-changing position, the tool die holder is positionable by the tool drive along the stroke axis away from the workpiece support based on the tool head height of a tool die secured to the tool die holder.

For use on a conventional machine, the tool heads of the tool dies generally have to be configured in such a manner that, in the tool-changing position of the tool die holder, the tool heads are arranged below the workpiece support. The reason for this is that a tool die that projects above the workpiece support can impede positioning of the workpiece along the workpiece support. In certain embodiments, this size restriction does not apply. For example, in some embodiments, it is possible to use tool dies with tool heads that, in the tool-changing position of the tool die holder, project along the stroke axis above the workpiece support. After such a tool die has been inserted, the tool die holder can be lowered for the subsequent workpiece processing operation in accordance with the tool head height of the tool die until the tool head of the tool die no longer projects above the workpiece support.

In certain embodiments, the drive for the tool punch holder and the drive for the tool die holder are separate from each other. Consequently, a machine can be obtained in which the tool heads of the tool punches and the tool dies can be configured independently of each other over a wide range.

In some embodiments, the compensation movements are ascertained and controlled on the basis of tool data stored in a numerical control unit. This arrangement can provide ease of operation.

In certain embodiments, processing devices of the tools (e.g., processing devices of the tool punches and/or tool dies) are provided on the different-height tool heads. In that manner, the installation space available for supporting the processing devices can be chosen individually for each tool. In particular, the installation space can be increased relative to the installation space on tools for conventional machines. As a result, the additional installation space can be used to increase tool stability. The additional installation space can alternatively or additionally be utilized for additional tool elements. The use of processing devices in the form of forming bars or cutting edges can be particularly advantageous with the machines described herein.

In some embodiments, the tools of the machine are punching tools or forming tools. In certain embodiments, the machine can be used in flexible sheet metal processing in the form of punching and forming machines. Those machines can permit various workpiece processing operations to be performed using the same machine. In some cases, for example, sheet metal parts can be cut free from the sheet metal composite along their outer contour and, in addition, forming operations can be performed on the sheet metal parts.

In certain embodiments, the tool punch holder is positionable, based on the tool punch head height of a tool punch secured to the tool punch holder, relative to the workpiece support along the stroke axis by the tool drive.

In some embodiments, the tool drive is configured to position the tool punch holder in any one of a stroke starting position from which a working stroke of the tool punch holder begins, a stroke ending position in which the working stroke of the tool punch holder ends, and a working home position in which the tool punch holder remains during workpiece processing.

In certain embodiments, the tool die holder is positionable, based on the tool die head height of a tool die secured to the tool die holder, relative to the workpiece support along the stroke axis by the tool drive.

In some embodiments, the tool drive is configured to position the tool die holder in any one of a stroke starting position from which a working stroke of the tool die holder begins, a stroke ending position in which a working stroke of the tool die holder ends, and a working home position in which the tool die holder remains during workpiece processing.

In certain embodiments, the tool drive is configured to position the tool die holder in a tool-changing position in which one of the tool dies can be inserted into and removed from the tool die holder.

In some embodiments, the tool drive is configured to, starting from the tool-changing position, move the tool die holder in a direction along the stroke axis and away from the workpiece support to another position based on the tool die head height of a tool die secured to the tool die holder.

In certain embodiments, the tool drive includes a tool punch drive associated with the tool punch holder and a tool die drive associated with the tool die holder, and the tool punch drive and the tool die drive are capable of moving the tool punch holder and the tool die holder to multiple different spaced apart positions along the stroke axis.

In some embodiments, the plate workpiece processing machine further includes a numerical control unit configured to control positioning movements of the tool punch holder based on tool data of a tool punch secured to the tool punch holder, and the control unit is further configured to control positioning movements of the tool die holder based on tool data of a tool die secured to the tool die holder.

In certain embodiments, the tool data of the tool punch and the tool data of the tool die are stored in the numerical control unit.

In some embodiments, the plate workpiece processing machine further includes a processing device on a workpiece side of the tool punch head of each of the tool punches.

In certain embodiments, the plate workpiece processing machine further includes a processing device on a workpiece side of the tool die head of each of the tool dies.

In some embodiments, the processing device includes one or more forming bars.

In certain embodiments, the processing device includes one or more cutting edges.

In some embodiments, the tool punches and the tool dies are associated with each other in pairs to form tools.

In certain embodiments, at least one of the tools is in the form of a punching tool.

In some embodiments, at least one of the tools is in the form of a forming tool.

In an additional aspect, a plate workpiece processing machine includes a workpiece support, a first tool holder, a second tool holder, a tool drive operable to move at least one of the first and second tool holders to reduce a separation between the tool holders along a stroke axis for processing of a plate-like workpiece supported on the workpiece support, multiple first tools selectively mountable on the first tool holder, and multiple second tools selectively mountable on the second tool holder. Each of the first tools has a first tool shank and a first tool head adjoining the first tool shank. The first tool shank of each first tool is configured to be secured to the first tool holder and the first tool head of each first tool is radially enlarged relative to the first tool shank and is arranged towards the workpiece when the first tool is mounted on the first tool holder. Each of the second tools has a second tool shank and a second tool head adjoining the second tool shank. The second tool shank of each second tool is configured to be secured to the second tool holder and the second tool head of each second tool is radially enlarged relative to the second tool shank and is arranged towards the workpiece when the second tool is mounted on the second tool holder. The first tool heads of at least some of the first tools have differing heights along the stroke axis as mounted on the first tool holder, and the tool drive is configured to position the first tool holder with respect to the stroke axis based on the first tool head height of a first tool secured to the first tool holder.

In some embodiments, the second tool heads of at least some of the second tools have differing heights along the stroke axis as mounted on the second tool holder, and the tool drive is configured to position the second tool holder with respect to the stroke axis based on the second tool head height of a second tool secured to the second tool holder.

In certain embodiments, the tool drive is configured to position the first tool holder, based on the height of the first tool head of a first tool secured to the first tool holder, in any one of a stroke starting position from which a working stroke of the first tool holder begins, a stroke ending position in which the working stroke of the first tool holder ends, and a working home position in which the first tool holder remains during workpiece processing.

In some embodiments, the tool drive is configured to position the first tool holder, based on the height of the first tool head of a first tool to be secured to the first tool holder, in a tool-changing position in which the first tool can be inserted and removed from the first tool holder.

In certain embodiments, the tool drive is configured to move the first tool holder in a direction away from the workpiece support from the tool-changing position to another position based on the height of the first tool head of a first tool secured to the first tool holder.

In some embodiments, the first tool is a tool punch.

In certain embodiments, the second tool is a tool die.

In some embodiments, the plate workpiece processing machine further includes a numerical control unit configured to control positioning movements of the first tool holder based on tool data of a first tool secured to the first tool holder.

In certain embodiments, the tool data includes the height of the first tool head of the first tool secured to the first tool holder.

In some embodiments, at least some of the first tools include a processing device extending from a surface of the first tool head.

In a further aspect, a method of processing a workpiece includes holding a first tool in a first tool holder, and holding a second tool in a second tool holder. The first tool has a first tool head adjoining a first tool shank. The first tool head is arranged on the workpiece side of the first tool shank. The second tool has a second tool head adjoining a second tool shank. The second tool head is arranged on the workpiece side of the second tool shank. The first and second tool holders are spaced along a stroke axis. The method further includes positioning the first tool holder along the stroke axis based on the height of the first tool head.

In certain embodiments, positioning the first tool holder comprises moving the first tool holder to any one of a stroke starting position from which a working stroke of the first tool holder begins, a stroke ending position in which the working stroke of the first tool holder ends, and a working home position in which the first tool holder remains during workpiece processing, while the one of the first tools is held in the tool holder.

In some embodiments, positioning the first tool holder includes moving the first tool holder to a tool changing position prior to holding the first tool in the first tool holder.

In certain embodiments, multiple first tools are provided, and at least some of the first tool heads of the first tools have differing heights.

In some embodiments, the first tool is positioned along the stroke axis using a tool drive.

In certain embodiments, positioning the first tool along the stroke axis includes positioning the first tool such that a processing device of the first tool contacts the workpiece.

Embodiments of the invention can include one or more of the following advantages.

The machine can advantageously provide expanded possibilities for configuring the tools that can be used on the machine. For example, because the tool punch holder is positionable based on the tool head height of a tool punch secured to the tool punch holder and the tool die holder is positionable based on the tool head height of a tool die secured to the tool die holder, the restrictions on the tool configuration which have to be taken into consideration in the case of conventional machines are considerably reduced.

Another advantage of the machine is that it enables the use of tools with tool heads that have a greater height and consequently occupy a larger installation space compared with tool heads of tools configured for use with certain conventional machines. At the same time, due to the compensatory positioning movements of the tool holders, it is also possible to use tools configured for use with those conventional machines.

The compensation movements of the tool holders by the tool drive can advantageously take place in a mechanically driven manner and hence automatically.

DESCRIPTION OF DRAWINGS

Similar reference numbers indicate like elements.

DETAILED DESCRIPTION

Figure 1:
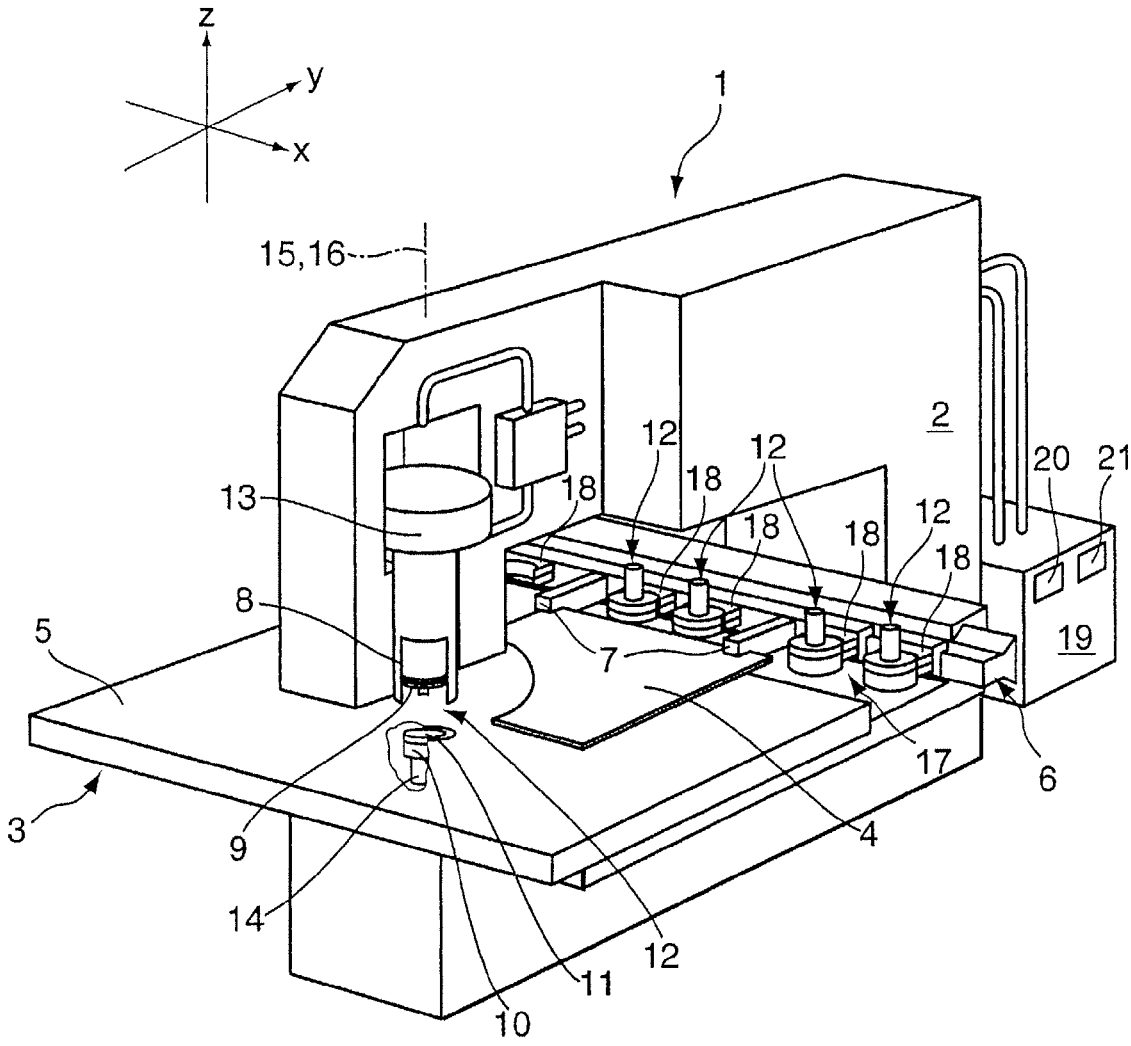
FIG. 1 shows a machine for cutting and/or forming metal sheets.

FIG. 1 shows a machine for cutting and/or forming plate-like workpieces in the form of a punching/forming machine 1 for processing metal sheets. The punching/forming machine 1 has a C-shaped machine frame 2 having, arranged in the throat thereof, a workpiece support in the form of a workpiece table 3 which serves to support a metal sheet 4 which is to be processed. On its upper side, the workpiece table 3 forms a horizontal support plane 5 for the metal sheet 4 to be processed. The support plane 5 extends parallel to the x/y plane of the coordinate system shown in FIG. 1. The metal sheet 4 is movable in the support plane 5 of the workpiece table 3 by a coordinate drive 6, which is clamped in position by clamps 7.

A tool punch holder 8 is arranged at the front end of the upper arm of the C-shaped machine frame 2. A tool punch 9 is secured to the tool punch holder 8. A tool die holder 10 is also provided at the front end of the lower arm of the C-shaped machine frame 2. A tool die 11 is secured to the tool die holder 10. The tool punch 9 and the tool die 11 form a tool 12.

A tool drive of the punching/forming machine 1 is formed by a tool punch drive 13 and a tool die drive 14. The tool punch holder 8 together with the tool punch 9 secured thereto can be raised and lowered relative to the workpiece table 3 along a stroke axis 15 by the tool punch drive 13. In a comparable manner, the tool die holder 10 together with the tool die 11 secured thereto can be raised and lowered relative to the workpiece table 3 along the stroke axis 15 by the tool die drive 14.

In addition, the tool punch holder 8 and the tool die holder 10 can be adjusted with regard to their rotational position about a tool rotation axis 16, which is identical to the stroke axis 15, by a tool turning drive (not shown in detail).

Provided on the coordinate guide 6 is a linear magazine 17 with additional tools 12. The tools 12 situated in the linear magazine 17 are each held by a tool cassette 18 and can each be secured to the tool punch holder 8 and the tool die holder 10 as required for workpiece processing.

In order to replace the tool 12 secured in the tool holders 8, 10 by one of the tools 12 disposed on the linear magazine 17, the tool punch holder 8 and the tool die holder 10 are first transferred along the stroke axis 15 to tool-changing positions. Then, an empty tool cassette 18 of the linear magazine 17 is moved against the side of the tool holders 8, 10 by the coordinate drive 6. In the process, holding arms of the tool cassette 18 engage around the tool punch 9 and the tool die 11. After the holding arms of the tool cassette 18 have securely engaged around the tool punch 9 and the tool die 11, the tool 12 is released by the tool punch holder 8 and by the tool die holder 10. The tool 12 can then be pushed sideways out of the tool holders 8, 10 by the coordinate drive 6. The tool 12 that is to be inserted as a replacement is then positioned within the tool holders 8, 10 by the coordinate drive 6, and is clamped therein.

During tool-changing and during a workpiece processing operation, all of the drives of the punching/forming machine 1 are controlled by a numerical control unit 19. The numerical control unit 19 includes a storage device (e.g., a memory device) 20 for storing tool data and a control device (e.g., a processor and/or a controller) 21 in order to calculate and control both the raising and lowering movements of the tool punch holder 8 and the raising and lowering movements of the tool die holder 10 based on the stored tool data.

Figure 2:
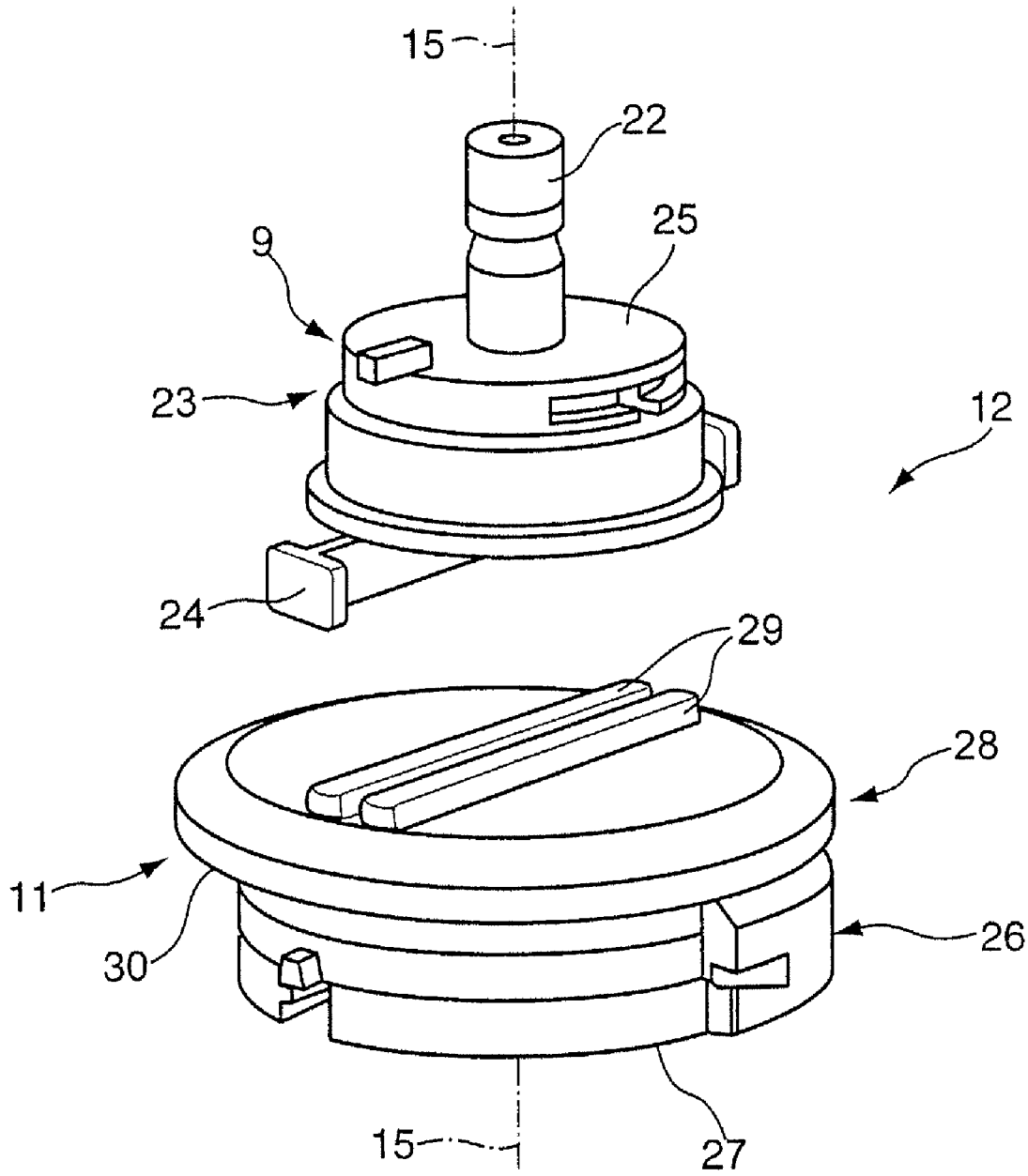
FIG. 2 shows a forming tool of the machine of FIG. 1.

FIG. 2 shows by way of example a tool 12 of the punching/forming machine 1 in the form of a so-called "card guide tool". The illustrated relative arrangement of the tool punch 9 and the tool die 11 along the stroke axis 15 corresponds to the relative arrangement when the tool punch 9 and the tool die 11 have been secured to the tool holders 8, 10 of the punching/forming machine 1.

The tool punch 9 has a tool shank 22 which extends along the stroke axis 15. The tool punch 9 can be secured or clamped to the tool shank 22 of the tool punch holder 8. A tool head 23 adjoins the tool shank 22 along the stroke axis 15 and is enlarged radially (with respect to the stroke axis 15) relative to the tool shank 22. On the side of the tool head 23 associated with the workpiece (i.e., the underside of the tool head 23), a processing device in the form of a forming bar 24 is provided. On the side of the tool head 23 facing away from the workpiece, a contact face 25 is provided. The tool punch 9 is supported along the stroke axis 15 on the tool punch holder 8 by the contact face 25. The height of the tool head 23 corresponds to the distance between the contact face 25 and the lowermost edge or face of the forming bar 24.

The tool die 11 similarly has a tool shank 26 for securing the tool die 11 to the tool die holder 10. A contact face 27 on the underside of the tool shank 26 serves to support the tool die 11 along the stroke axis 15.

Adjoining the tool shank 26 on the workpiece side and along the stroke axis 15, a disc-shaped tool head 28 is provided on the tool die 11. The tool head 28 is slightly enlarged radially (with respect to the stroke axis 15) relative to the tool shank 26. Two processing devices in the form of forming bars 29 are provided on the tool head 28. The height of the tool head 28 is measured as the distance between the underside 30 of the tool head 28 and the uppermost edge or face of the forming bars 29.

The other tools 12 disposed in the linear magazine 17 of the punching/forming machine 1 of FIG. 1 differ from the tool 12 shown in FIG. 2 with respect to the structural shape of the tool heads 23, 28. In particular, various tool punches 9 with tool heads 23 of differing heights and various tool dies 11 with tool heads 28 of differing heights are provided. The tool shanks 22, 26 of the tool punches 9 and the tool dies 11 are each of a structurally uniform configuration. For example, each of the tool shanks 22 of the tool punches 9 can have substantially the same height and diameter, and each of the tool shanks 26 of the tool dies 11 can have substantially the same height and diameter, or are otherwise constructed for interchangeable mounting in a common holder.

For holding the various tools 12 in the linear magazine 17, tool cassettes 18 in two different sizes are provided. The different sized tool cassettes 18 hold their respective tool punches 9 and tool dies 11 such that the tool punches 9 and tool dies 11 are spaced from each other at different distances along the stroke axis 15.

The conditions at the tool holders 8, 10 of the punching/forming machine 1 during a workpiece processing operation will be explained below with reference to FIGS. 3-6. On the left-hand side of FIGS. 3-6, the conditions in the case of a workpiece processing operation with a tool 12 of a first type are shown. For comparison, on the right-hand side of FIGS. 3-6, the conditions in the case of a workpiece processing operation with a tool 12' of a second type are illustrated. The tool 12 on the left-hand side has distinctly lower tool heads 23, 28 along the stroke axis 15 than does the tool 12' on the right-hand side. Both tools 12, 12' are used to produce formations in the workpiece.

Figure 3:
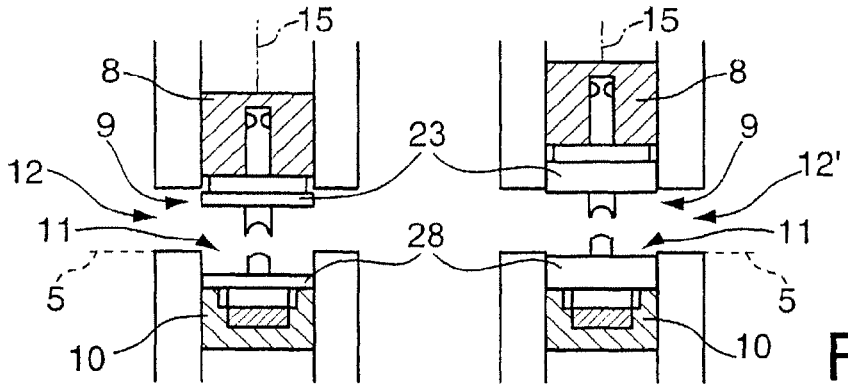
FIGS. 3-6 show the conditions at the tool holders of the machine of FIG. 1 during a workpiece processing operation with a tool of a first type and, for comparison, with a tool of a second type.

In FIG. 3, the conditions directly after insertion of the tools 12, 12' are illustrated. As shown, the tool punch holder 8 and the tool die holder 10 are in their tool-changing positions along the stroke axis 15.

The tool-changing positions of the tool die holder 10 are identical for both tools 12, 12'—as they are for all other tools—since, in the linear magazine 17, the lower side of all the tool dies 11 (i.e., contact face 27) is at the same height along the stroke axis 15. That corresponding horizontal position is retained by the tool dies 11 also when they are being inserted sideways into the tool die holder 10.

The tool-changing positions of the tool punch holder 8, however, differ from each other. On the left-hand side of FIG. 3, the tool punch holder 8 has been lowered further along the stroke axis 15 than on the right-hand side. The reason for the different tool-changing positions of the tool punch holder 8 is that the left-hand tool 12 is held in the linear magazine 17 by a lower tool cassette 18 than the right-hand tool 12'. The tool punch 9 shown on the left-hand side of FIG. 3 is consequently arranged along the stroke axis 15 lower than that on the right-hand side of FIG. 3. Those differing positions of the tool punches 9 along the stroke axis 15 are taken into consideration on insertion of the tool punches 9 in the tool punch holder 8 by the differing tool-changing positions of the tool punch holder 8.

It is otherwise apparent from FIG. 3 that the tool die 11 on the left-hand side of FIG. 3 is arranged, directly after insertion, completely below the support plane 5 of the workpiece table 3, whereas in the case of the tool 12' on the right-hand side of FIG. 3 the tool head 28 of the tool die 11 (e.g., the forming bars 29 of the tool head 28 of the tool die 11) projects along the stroke axis 15 above the support plane 5 of the workpiece table 3.

Figure 4:
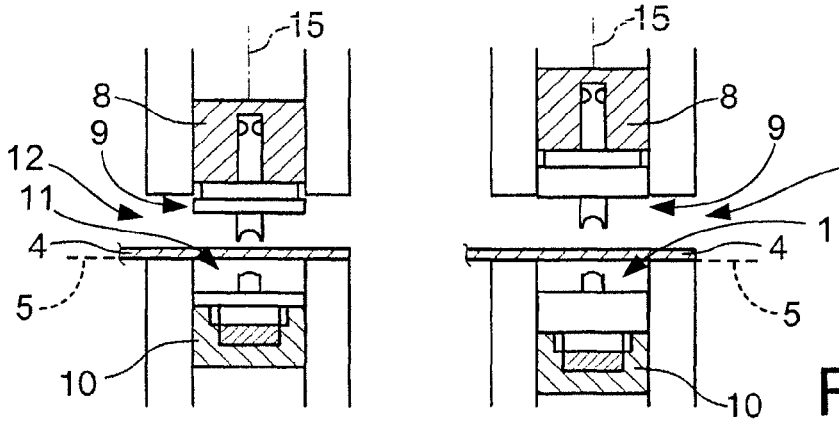
Figure 5:
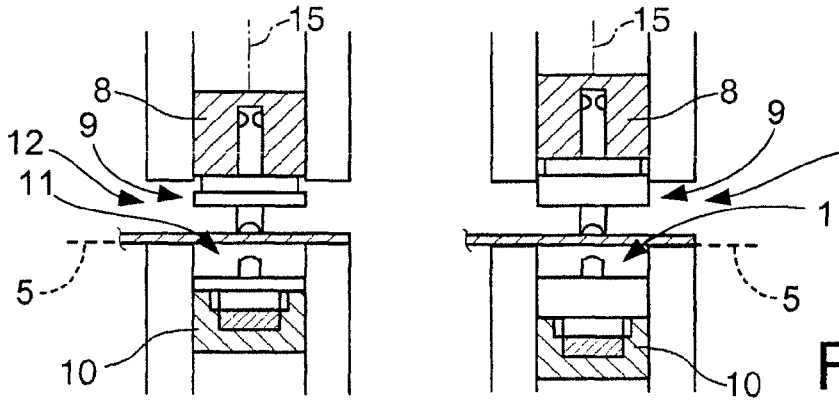

Starting with the conditions shown in FIG. 3, the tool die holder 10 is lowered to various stroke starting positions based on the height of the tool heads 28 of the clamped tool dies 11 (FIG. 4). In addition, the tool punch holder 8 is lowered to various working home positions based on the height of the tool heads 23 of the clamped tool punches 9. In these working home positions, the undersides of the tool heads 23 are disposed on the upper side of the metal sheet 4 to be processed (FIG. 5).

Figure 6:
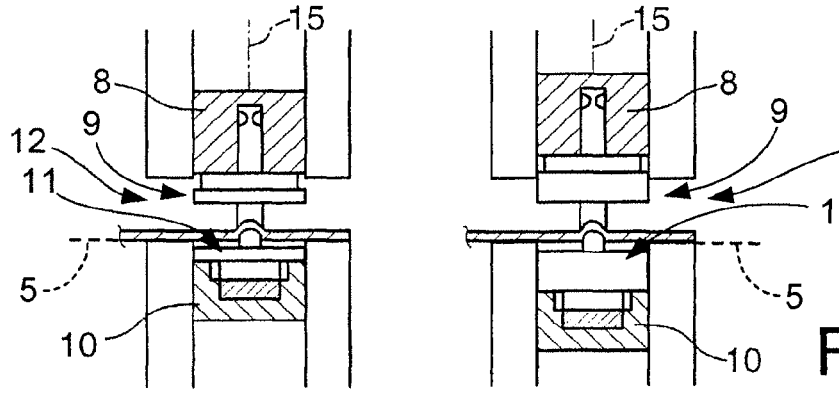

FIG. 6 shows the conditions of the tools 12, 12' after completion of a working stroke executed by the tool die holder 10 starting from the stroke starting positions. The stroke end positions of the tool die holders 10 differ according to the height of the tool head 28.

As an alternative or in addition to the tools 12, 12' shown, which can be used for forming a workpiece, punching tools may also be employed on the punching/forming machine 1. It is equally possible to provide tools that are configured in such a manner that the working stroke is executed by the tool punch holder 8 and the tool die holder 10 adopts a working home position in the workpiece processing operation.

In the storage device 20 of the numerical control unit 19 of the punching/forming machine 1, tool data on the tools 12 set up in the linear magazine are stored. The tool data make it possible to ascertain the desired positions of the tool punch holder 8 and the tool die holder 10. For example, the tool head heights of the various tool punches 9 and of the various tool dies 11 (or tool data dependent on the tool head heights) can be stored in the storage device 20.

Other embodiments are within the scope of the following claims.

What is claimed is:

1. A plate workpiece processing machine, comprising:

a workpiece support;

a tool punch holder configured to hold a tool punch;

a tool die holder configured to hold a tool die;

a tool drive operable to move at least one of the tool punch holder and the tool die holder to reduce a separation between the tool punch holder and the tool die holder along a stroke axis for processing of a plate-like workpiece supported on the workpiece support;

a plurality of tool punches selectively mountable on the tool punch holder, each of the tool punches having a tool punch shank and a tool punch head adjoining the tool punch shank, the tool punch shank of each tool punch being configured to be secured to the tool punch holder and the tool punch head of each tool punch being radially enlarged relative to the tool punch shank and being arranged towards the workpiece when the tool punch is mounted on the tool punch holder; and a plurality of tool dies selectively mountable on the tool die holder, each of the tool dies having a tool die shank and a tool die head adjoining the tool die shank, the tool die shank of each tool die being configured to be secured to the tool die holder and the tool die head of each tool die being radially enlarged relative to the tool die shank and being arranged towards the workpiece when the tool die is mounted on the tool die holder, wherein the tool punch heads of at least some of the tool punches have differing heights along the stroke axis as mounted on the tool punch holder, and the tool die heads of at least some of the tool dies have differing heights along the stroke axis as mounted on the tool die holder, and wherein the tool drive is configured to position the tool punch holder with respect to the stroke axis based on the tool punch head height of the tool punch of the plurality of tool punches having differing heights along the stroke axis which is secured to the tool punch holder, and to position the tool die holder with respect to the stroke axis based on the tool die head height of the tool die of the plurality of tool dies having differing heights along the stroke axis which is secured to the tool die holder.

2. The plate workpiece processing machine of claim 1, wherein the tool punch holder is positionable, based on the tool punch head height of a tool punch secured to the tool punch holder, relative to the workpiece support along the stroke axis by the tool drive.

3. The plate workpiece processing machine of claim 2, wherein the tool drive is configured to position the tool punch holder in any one of a stroke starting position from which a working stroke of the tool punch holder begins, a stroke ending position in which the working stroke of the tool punch holder ends, and a working home position in which the tool punch holder remains during workpiece processing.

4. The plate workpiece processing machine of claim 1, wherein the tool die holder is positionable, based on the tool die head height of a tool die secured to the tool die holder, relative to the workpiece support along the stroke axis by the tool drive.

5. The plate workpiece processing machine of claim 4, wherein the tool drive is configured to position the tool die holder in any one of a stroke starting position from which a working stroke of the tool die holder begins, a stroke ending position in which a working stroke of the tool die holder ends, and a working home position in which the tool die holder remains during workpiece processing.

6. The plate workpiece processing machine of claim 4, wherein the tool drive is configured to position the tool die holder in a tool-changing position in which one of the tool dies can be inserted into and removed from the tool die holder.

7. The plate workpiece processing machine of claim 6, wherein the tool drive is configured to, starting from the tool-changing position, move the tool die holder in a direction along the stroke axis and away from the workpiece support to another position based on the tool die head height of a tool die secured to the tool die holder.

8. The plate workpiece processing machine of claim 1, wherein the tool drive comprises a tool punch drive associated with the tool punch holder and a tool die drive associated with the tool die holder, and the tool punch drive and the tool die drive are capable of moving the tool punch holder and the tool die holder to multiple different spaced apart positions along the stroke axis.

9. The plate workpiece processing machine of claim 1, further comprising a numerical control unit configured to control positioning movements of the tool punch holder based on tool data of a tool punch secured to the tool punch holder, the control unit being further configured to control positioning movements of the tool die holder based on tool data of a tool die secured to the tool die holder.

10. The plate workpiece processing machine of claim 9, wherein the tool data of the tool punch and the tool data of the tool die are stored in the numerical control unit.

11. The plate workpiece processing machine of claim 1, further comprising a processing device on a workpiece side of the tool punch head of each of the tool punches.

12. The plate workpiece processing machine of claim 11, wherein the processing device comprises one or more forming bars.

13. The plate workpiece processing machine of claim 11, wherein the processing device comprises one or more cutting edges.

14. The plate workpiece processing machine of claim 1, further comprising a processing device on a workpiece side of the tool die head of each of the tool dies.

15. The plate workpiece processing machine of claim 14, wherein the processing device comprises one or more forming bars.

16. The plate workpiece processing machine of claim 14, wherein the processing device comprises one or more cutting edges.

17. The plate workpiece processing machine of claim 1, wherein the tool punches and the tool dies are associated with each other in pairs to form tools.

18. The plate workpiece processing machine of claim 17, wherein at least one of the tools is in the form of a punching tool.

19. The plate workpiece processing machine of claim 17, wherein at least one of the tools is in the form of a forming tool.

20. A plate workpiece processing machine, comprising:

a workpiece support;

a first tool holder;

a second tool holder;

a tool drive operable to move at least one of the first and second tool holders to reduce a separation between the tool holders along a stroke axis for processing of a plate-like workpiece supported on the workpiece support;

a plurality of first tools selectively mountable on the first tool holder, each of the first tools having a first tool shank and a first tool head adjoining the first tool shank, the first tool shank of each first tool being configured to be secured to the first tool holder and the first tool head of each first tool being radially enlarged relative to the first tool shank and being arranged towards the workpiece when the first tool is mounted on the first tool holder; and a plurality of second tools selectively mountable on the second tool holder, each of the second tools having a second tool shank and a second tool head adjoining the second tool shank, the second tool shank of each second tool being configured to be secured to the second tool holder and the second tool head of each second tool being radially enlarged relative to the second tool shank and being arranged towards the workpiece when the second tool is mounted on the second tool holder, wherein the first tool heads of at least some of the first tools have differing heights along the stroke axis as mounted on the first tool holder, and the tool drive is configured to position the first tool holder with respect to the stroke axis based on the first tool head height of the first tool of the plurality of first tools having differing heights along the stroke axis which is secured to the first tool holder.

* * * * *

UNITED STATES PATENT AND TRADEMARK OFFICE

CERTIFICATE OF CORRECTION

PATENT NO. : 8,201,432 B2
APPLICATION NO. : 12/390601
DATED : June 19, 2012
INVENTOR(S) : Peter Bytow It is certified that error appears in the above-identified patent and that said Letters Patent is hereby corrected as shown below:

On page 1, after Assignee, delete "Ditzignen (DE)" and insert --Ditzingen (DE)--.

Signed and Sealed this
Seventh Day of August, 2012

David J. Kappos

David J. Kappos
*Director of the United States Patent and Trademark Office*